United States Patent [19]

Gurries

[11] 4,258,956

[45] Mar. 31, 1981

[54] METHOD AND APPARATUS FOR DRIVING A SINGLE TRANSVERSELY ELONGATED TOOL WITH A PLURALITY OF FORCE TRANSMITTING BEAMS

[75] Inventor: Raymond A. Gurries, Reno, Nev.

[73] Assignee: The Gurries Company, Sparks, Nev.

[21] Appl. No.: 25,484

[22] Filed: Mar. 30, 1979

Related U.S. Application Data

[63] Continuation-in-part of Ser. No. 916,112, Jun. 15, 1978, abandoned, and a continuation-in-part of Ser. No. 973,163, Dec. 26, 1978, which is a continuation-in-part of Ser. No. 873,249, Jan. 30, 1978, abandoned.

[51] Int. Cl.[3] ..... A01B 35/00

[52] U.S. Cl. ..... 299/14; 37/DIG. 18; 172/40; 173/49; 173/101; 299/37

[58] Field of Search ..... 37/DIG. 18; 172/40; 299/37, 14; 173/49, 101; 404/133

[56] References Cited

U.S. PATENT DOCUMENTS

| | | | |
|---|---|---|---|
| 3,628,265 | 12/1971 | Galis | 173/49 X |
| 3,633,683 | 1/1972 | Shatto | 173/49 |
| 3,770,322 | 11/1973 | Cobb et al. | 37/DIG. 18 |
| 3,966,344 | 6/1976 | Haker et al. | 404/133 X |

*Primary Examiner*—Ernest R. Purser

*Attorney, Agent, or Firm*—Townsend and Townsend

[57] ABSTRACT

An elongated tool is mounted for reciprocal motion on a support frame. A plurality of resonant force transmitting beams each having an input, an output, and at least one resonant node, are supported by the frame so their outputs are spaced apart adjacent to the length of the tool. A sonic generator operating at or near the resonant frequency of the beams is coupled to the beam inputs to produce at the beam outputs resonant vibration about a neutral position. Each beam is pivotally mounted for rotation about its resonant node and such rotation is rigidly limited such that the spacing between the neutral position of the output of each beam and the tool is the same, which synchronizes coupling of force from the beam outputs to the tool. The pivotal node support comprises a closed hollow annular elastic housing and a fluid filling the housing.

9 Claims, 8 Drawing Figures

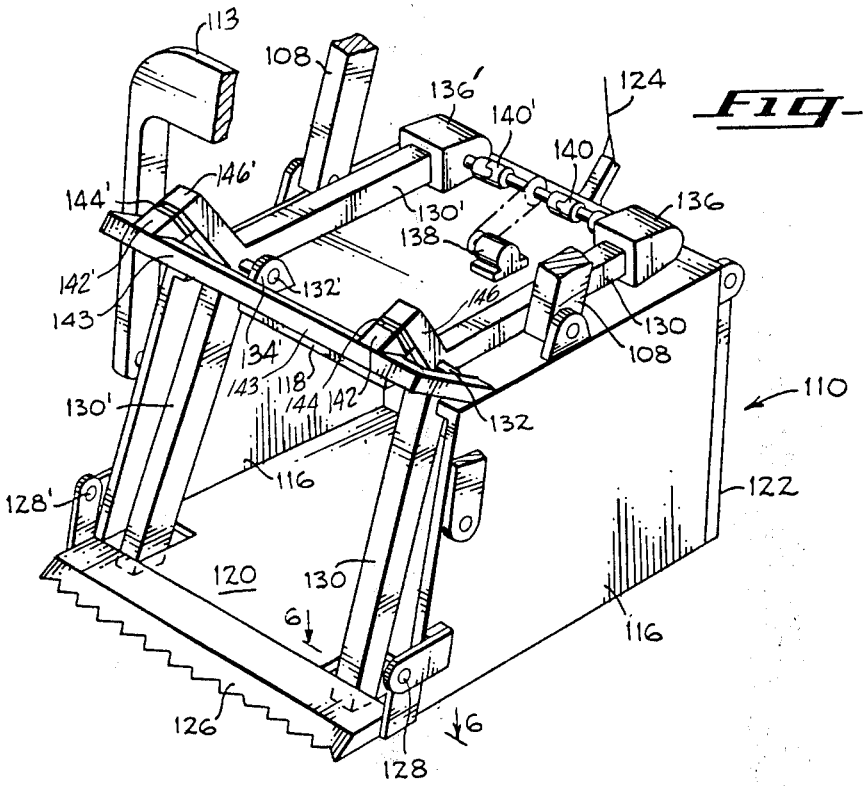
Fig. 5
Fig. 6
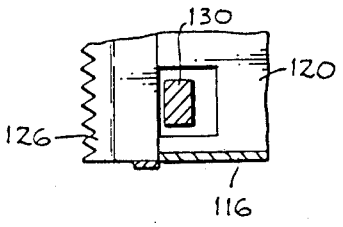
Fig. 7
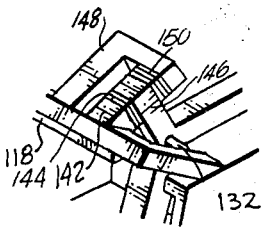

METHOD AND APPARATUS FOR DRIVING A SINGLE TRANSVERSELY ELONGATED TOOL WITH A PLURALITY OF FORCE TRANSMITTING BEAMS

CROSS REFERENCE TO RELATED APPLICATIONS

This application is a continuation-in-part of my copending application Ser. No. 916,112, filed June 15, 1978 and now abandoned, and application Ser. No. 973,163, filed Dec. 26, 1978, which is a continuation-in-part of application Ser. No. 873,249, filed Jan. 30, 1978 and now abandoned. The disclosures of these applications are incorporated fully herein by reference.

BACKGROUND OF THE INVENTION

This invention relates to power driving mechanisms for tools and, more particularly, to apparatus and method for driving a transversely elongated tool with a plurality of force transmitting beams.

Various forms of power sources—mechanical, hydraulic, pneumatic, or others—have been used to drive tools for various purposes such as digging coal, cutting trees, driving piles, pavement removal, earth working, and various agricultural operations, among others. The specific tool is designed for the particular job.

Recently, a power source has been developed employing a resonant vibration system driven by a sonic generator, an example being shown and described in U.S. Pat. No. 3,367,716. While the resonant vibration principle has merit in that considerable force can be generated, the proper transfer of such force to the material has proven extremely difficult to accomplish, particularly when the tool is transversely elongated. A transversely elongated sonicly driven tool has application in a number of machines including a pavement planer, a shovel bucket, a bulldozer, and a front end loader.

It has been proposed to drive a transversely elongated tool with a plurality of resonant beams whose outputs are spaced apart adjacent to the length of the tool. An upper node support of each resonant beam is pivotally attached to a support frame while a resilient beam stop is mounted on the support frame to limit rotation of the beam during operation in the manner disclosed in U.S. Pat. No. 3,336,802. It has been found in practice that the beam stops are compressed to a different degree depending upon the resistance encountered by the tool in the region of the corresponding beam. This is objectionable because it imposes moments on the tool and reduces the effectiveness of the tool's function.

SUMMARY OF THE INVENTION

According to the invention, an elongated tool is mounted on a support frame for reciprocal motion transverse to its length, and a plurality of force transmitting beams each having an input and an output are supported by the frame so the outputs of the beams are spaced apart adjacent to the length of the tool without attachment thereto. Vibrations are coupled in synchronism to the inputs of the force transmitting beams by sonic oscillators, and the outputs of the force transmitting beams are coupled to the tool in synchronism. As a result, the outputs of the force transmitting beams transfer the same force to the tool regardless of the variations in resistance encountered by the tool along its length.

A feature of the invention, which is also useful in the case of a single force transmitting beam, is to support a resonant force transmitting beam by pivotally mounting the beam for rotation about one of its resonant nodes, and rigidly limiting rotation of the beam about such resonant node so as to fix precisely the neutral position of the output of the beam.

In the preferred embodiment, the vibrations of the sonic oscillator are at or near a resonant frequency of the force transmitting beams, each beam is pivotally mounted on the support frame for rotation about one of its resonant nodes, and the outputs of the beams are coupled to the tool in synchronism by rigidly limiting rotation of each beam about such resonant node such that the spacing between the neutral position of the output of each beam and the tool is the same.

Another feature of the invention is a resilient node support for a resonant force transmitting beam comprising a closed annular hollow elastic housing and a fluid filling the housing. The resiliency of the node support can be controlled by changing the fluid pressure.

BRIEF DESCRIPTION OF THE DRAWINGS

The features of specific embodiments of the best mode contemplated of carrying out the invention are illustrated in the drawings, in which:

FIG. 5 is a perspective view of the shovel bucket of the power shovel of FIG. 4;

FIG. 6 is a top plan view of a portion of the shovel bucket of FIG. 5 taken through plane 6—6; and FIG. 7 is a perspective view of an alternative version of a portion of the shovel bucket of FIG. 5.

DETAILED DESCRIPTION OF THE SPECIFIC EMBODIMENTS

Figure 1:
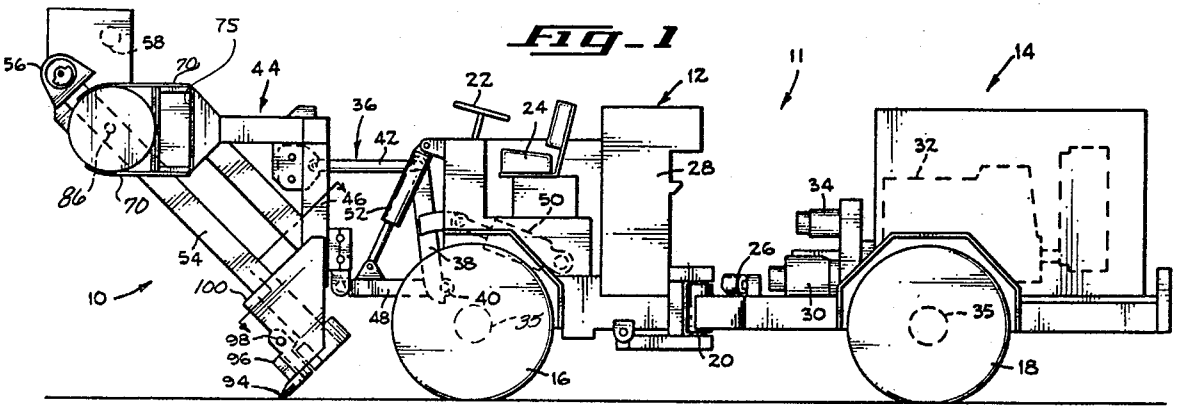
FIG. 1 is a side elevation view of a pavement planer incorporating the principles of the invention.
Figure 2:
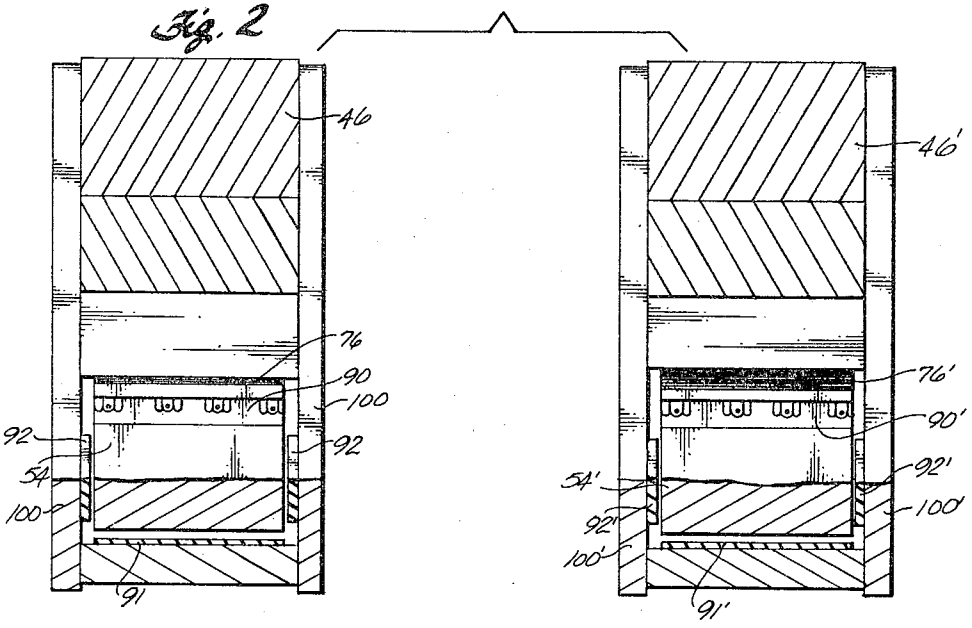
FIG. 2 is a plan view of a portion of the pavement planer of FIG. 1 taken through plane 2—2.

With initial reference to FIGS. 1 and 2, a pavement planing assembly generally indicated at 10 is mounted at the front of a mobile carrier 11 which includes forward and rearward frame sections 12, 14, each supported by two rubber-tired wheels 16, 18, the two frame sections being connected by a vertical pivot pin 20 which enables articulation of the frame sections for purposes of steering.

A steering wheel 22 is mounted forwardly of a driver's seat 24 on the front section 12 of the frame and is arranged to energize, upon turning, a hydraulic ram 26 pivotally joining the frame sections 12, 14 so as to effect articulation thereof and consequent steering. A hydraulic pump 30 is mounted on the rear section 14 of the frame, and driven by an internal combustion engine 32. Fluid from a hydraulic reservoir 28 is driven by pump 30 through suitable hydraulic conduits (not shown) to hydraulic ram 26.

The engine 32 also drives a second hydraulic pump 34 which is hydraulically connected to hydraulic motors 35 to drive the wheels 16 on the front frame section 12 and the wheels 18 on the rear frame section 14, thus to provide motive power for the entire mobile carrier 11 in a generally conventional fashion. As will be understood, the motive power delivered to the wheels will urge the front mounted cutting assembly 10 against material being cut with a certain tractive force which, for cutting a six-foot swath of cencrete or asphalt, should vary, for example, between 5,000 and 60,000 pounds, depending upon the material resistance and vehicle speed. Assuming the weight of the vehicle and its load, i.e., material cutting assembly 10 and mobile carrier 11, is 75,000 pounds, the maximum tractive force, i.e., motive power delivered to the wheels, must be less than the weight of the vehicle and its load, e.g., about 60,000 pounds, to prevent slippage of wheels 16 and 18. As is well known in the art, the maximum tractive force of the vehicle depends upon the friction between the wheels and the surface on which it moves. Assembly 10 is symmetricl about a center plane in the direction of movement, i.e., parallel to the plane of FIG. 1. Many of the elements on the right side of the center plane, as viewed from the front, i.e., the left in FIG. 1, which are identified by unprimed reference numerals, have counterparts on the left side of the center line, which are identified by the same reference numerals primed.

In order to mount the assembly 10, a pair of laterally spaced parallelogram units 36, 36' extend forwardly from the forward frame section 12. More particularly, the parallelogram units 36, 36' include parallel upstanding legs 38, 38' pivotally connected at their lower extremities is to the central portion of a fixed transverse shaft 40 on the front frame section 12, and pivotally joined at their upper extremities to the rear ends of forwardly projecting legs 42, 42'. These forwardly projecting legs 42, 42' are pivotally joined at laterally spaced positions (see FIG. 2) to a generally triangular cutting assembly frame 44. For further details of cutting assembly frame 44, reference is made to my copending application entitled PAVEMENT PLANING METHOD AND APPARATUS, application Ser. No. 973,163, filed Dec. 26, 1978, the disclosure of which is incorporated fully herein by reference. Lower and outwardly curving legs 48, 48' are pivotally connected at their opposite extremities to the lower ends of the support beams 46, 46' and the previously described shaft 40, thus completing the two parallelogram units 36, 36'.

A powered hydraulic ram 50 is pivotally secured between the forward frame section 12 and the rear upright legs 38, 38' of the parallelogram units 36, 36' to enable powered variation of the parallelogram disposition and accordingly the angular disposition of the cutting assembly 10. Additional powered hydraulic rams 52, 52' pivotally joined to the top of the frame section 12 and the lower generally horizontal legs 48, 48' of the parallelogram units 36, 36' enable substantially vertical adjustment of the cutting assembly.

The cutting assembly frame 44 supports a pair of identical resonant beams 54, 54' in the form of angularly upright parallel resonant beams composed of solid steel or other elastic material. A sonic generator in the form of a pair of synchronized orbiting mass oscillators 56, 56' is secured by bolts or the like to the upper extremity of each resonant beam and generally incorporates the principles of an orbiting mass oscillator of the type shown in either U.S. Pat. No. 2,960,314 or U.S. Pat. No. 3,217,551. (The disclosures of these patents are incorporated fully herein by reference.) Synchronization of orbiting mass oscillators 56, 56' is achieved by arranging all the eccentric weights at the same angular position on a common shaft driven by a single hydraulic motor 58. Motor 58 is energized through suitable hydraulic conduits (not shown) from a third hydraulic pump 60 operated by the previously described engine 32.

Energization of the exemplary embodiment illustrated, preferably provides a total peak energizing input force to the two resonant beams 54, 54' of 125,000 pounds in the form of sequential sonic oscillations at a frequency of approximately 100 cycles per second, i.e., at or near the resonant frequency of resonant beams 54, 54'. Thus, the total force provided by oscillators 56, 56' is larger than the weight of the vehicle and its load. These force oscillations, delivered to the upper end of the beam, cause resonant vibration thereof through appropriate dimensional design of such beam at that frequency so that a corresponding cyclical reciprocal vibration at the lower end of the beam is derived preferably with a total peak-to-peak displacement of approximately one inch. Each resonant beam 54, 54' is designed and so driven that two vibration nodes are formed thereon inwardly from its opposite extremities, and its ends are free to vibrate, i.e., reciprocate, and in fact do vibrate. In summary, resonant beams 54, 54' are driven to form standing wave vibrations in their fundamental free-form mode. Each beam is carried from the cutting assembly frame 44 at its upper node position. However, the connection is resilient to allow for node variations (pseudo-nodes) during actual operation.

Figure 3:
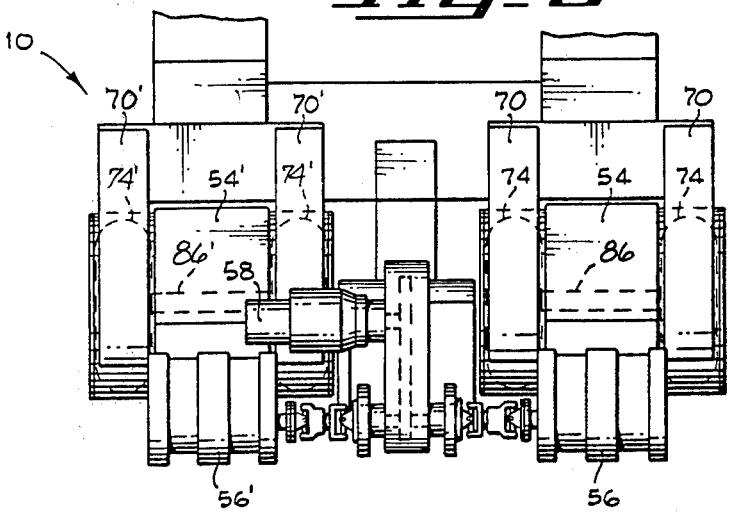
FIG. 3 is a top plan view of a portion of the pavement planer of FIG. 1.

Specifically, as illustrated in FIG. 3, pairs of rectangular brackets 75, 75' are attached, for example by welding, to the sides of cutting assembly frame 44. Pairs of annular resilient members 74, 74' in the form of pneumatic rubber tires are located inside pairs of cylindrical housings. The housing pairs are held on opposite sides of resonant beams 54, 54' by pairs of connecting arms 70, 70' attached, for example by bolting, to bracket pairs 75, 75'. Pairs of annular resilient members 74, 74' are mounted on pairs of central hubs (not shown). Shafts 86, 86' are press fitted into bores in resonant beams 54, 54' at their upper node positions. The hub pairs are mounted for rotation on the ends of shafts 86, 86' by pairs of bearings (not shown). Thus, resonant beams 54, 54' are supported by shafts 86, 86' and are pivotal about their axes by virtue of the bearing pairs. The members 74, 74' each form a closed hollow annular elastic bearing support housing surrounding the bearings by virtue of the elasticity of the tires and the fluid, i.e., air, filling the tires. In the manner of a spring, the described pneumatic tires, which serve as upper node supports for resonant beams 54, 54', absorb the vibrations caused by longitudinal changes in the node position (pseudo-nodes) and caused by forced vibration nodes during start up. The magnitude of the longitudinal changes in node position depends upon the extent of loading of the resonant beams, when the cutter blade described below is in engagement with a material to be cut, sheared, or planed, the amplitude of the vibration of the resonant beams, and the eccentric weight of oscillators 56, 56'. The internal tire pressure can be changed as required to control the spring constant. The pneumatic tires provide vibration isolation for cutting assembly frame 44 without generating much heat. To minimize heat and maximize vibration absorption, the tire pressure should be as low as possible. Although from the point of view of minimizing heat generation, it is preferable for the fluid filling the tires to be a gas such as air, it could also be a liquid if greater heat can be tolerated.

As shown in FIG. 2, at the lower node position, resonant beams 54, 54' are encompassed by rigid metal stop members 90, 90' at their rear, resilient rubber pads 91, 91' at their front, and pairs of resilient rubber pads 92, 92' at their sides. Pad pairs 92, 92' and pads 91, 91' comprise pieces of rubber vulcanized on metal mounting plates. Members 90, 90', pads 91, 91' are secured to the lower end of cutting assembly frame 44. When resonant beams 54, 54' are at rest, they lie on and are supported by pads 91, 91'. When resonant beams 54, 54' are resonating during operation of the apparatus, their lower node is driven up against stop members 90, 90' by the reaction of the material being worked upon as shown in FIG. 2, and remain in abutment with stop members 90, 90' during operation of the apparatus. Thus, stop members 90, 90' serve as rigid stationary lower node supports for resonant beams 54, 54' to rigidly limit rotation thereof about the upper node positions. Stop members 90, 90' and pads 91, 91' are spaced sufficiently far apart to enable resonant beams 54, 54' to be shimmed to synchronize their transfer of force to the work tool. Specifically, shims are inserted between stop members 90, 90' and stop mounts 57, 57' so the lower extremities of resonant beams 54, 54' in their neutral position (i.e., the at rest or nonvibrating beam condition) are both spaced precisely the same distance from the lever arms and cutter blade described below. Consequently, since oscillators 56, 56' run in phase and resonant beams 54, 54' reciprocate in phase, the lower extremities of resonant beams 54, 54' strike the cutter blade at the same time, i.e., in synchronism. As represented in FIG. 2 by the different thicknesses of shims 76, 76', stop members 90, 90' will in general have to be shimmed to a different degree to achieve the described synchronism, because of manufacturing tolerances. This is accomplished by the following procedure while the resonant beams are at rest, i.e., not vibrating: first, one of the stop members is shimmed; second, the cutter blade is lowered into contact with the road surface; third, mobile carrier 11 is driven forward to rotate resonant beams 54, 54' about their upper node supports, until one of the resonant beams contacts its stop member at the lower node support; and fourth, the other stop member is shimmed until the other resonant beam contacts it.

Figure 1A:
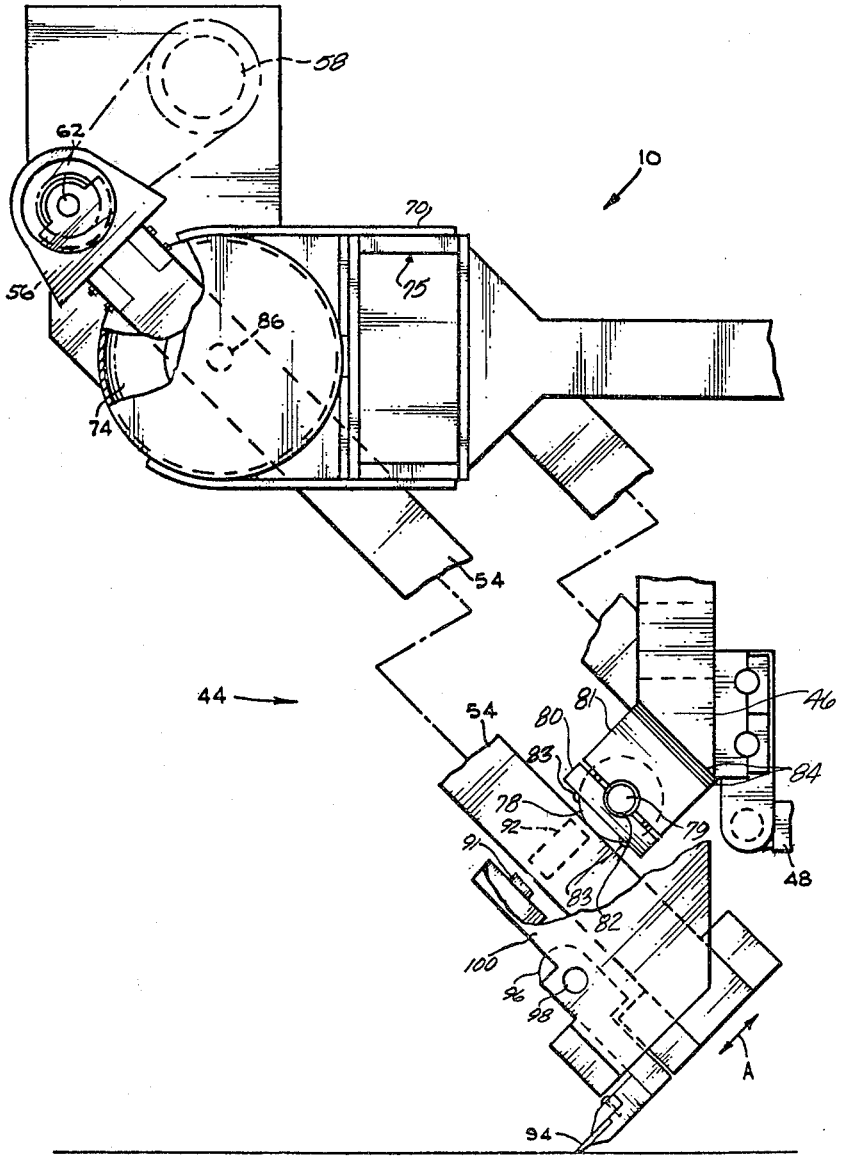
FIG. 1A is a fragmentary enlarged side view of the pavement planar of FIG. 1 with portions broken away to show interior details of an alternative embodiment of a lower node support.

FIG. 1A illustrates an alternative to stop member 90 as a lower node support for resonant beam 54. When a very large oscillator force is applied to resonant beams 54, 54', the beams tend to vibrate longitudinally as well as transversely, with the result that the beams substantially rub on stop members 90, 90'. This generates unwanted heat and causes substantial wear. A metallic roller 78 is fixedly mounted on a shaft 79. At each end, shaft 79 is clamped between mounting blocks 80 and 81, where shaft 79 rotates in bushings 82. Mounting blocks 80 and 81 are secured to the underside of support beams 46 by fasteners 83. Shims 84 are inserted between mounting block 81 and the underside of support beam 46 so as to position the edge of roller 78 to synchronize the transfer of force from resonant beam 54 to the work tool with the transfer of force from resonant beam 54' thereto. As resonant beam 54 vibrates longitudinally, roller 78, which makes nonslipping contact with beam 54, rotates in oscillatory fashion to provide a non-rubbing lower node support therefor. The lower node support for resonant beam 54' is the same as that described for resonant beam 54.

As shown in FIG. 1, assembly 10 includes a work took which takes the form of an angularly-directed and transversely-extending cutter blade 94 held in a blade base. Cutter blade 94 extends along the full width of the apparatus between beams 54, 54'. Lever arms 96, 96' are pivoted about substantially horizontal pivot pins 98, 98' on bracket pairs 100, 100'. Lever arms 96, 96' are attached, for example by welding, to the ends of the blade base near beams 54, 54'. Thus, cutter blade 94, and lever arms 96, 96' are pivotally supported by brackets 100, 100' so they are adjacent to the lower extremity of the resonant beams 54, 54'. When the beams reciprocate, they drive the cutter blade 94 in a forward and downward direction or to the left, as shown in FIG. 1, and thereafter withdraw from contact with the cutter blade 94 in its cyclical displacement in the opposite or rearward direction. Thus, only unidirectional driving impulses are delivered to the cutter blade 94 in its forward direction, and in alignment with its cutting direction, so the cutter blade 94 advances with a chisel-like action.

Cutter blade 94 comprises a work tool that moves along the road surface, which comprises the work path. Cutting assembly frame 44 functions as a tool holder or carrier. Continuous unidirectional force is applied thereto by mobile carrier 11 in a direction parallel to the work path. Oscillators 56, 56' generate a reciprocating force, at least one component of which acts parallel to the work path. Each resonant beam 54, 54' comprises a force transmitting member, its upper extremity comprising an input to which the reciprocating oscillator force is applied, and its lower extremity comprising an output from which the reciprocating force is transferred to the tool. The tool advances intermittently along the work path responsive to the continuous unidirectional force applied by mobile carrier 11 and the reciprocating force applied by oscillators 56 and 56'.

When the beams 54, 54' withdraw from contact with the cutter blade 94 during resonant vibration, a momentary gap is formed which will remain until a repeated forward motion of the beams 54, 54'. To maximize the cutting force, it has been found that contact of the beams with the cutter blade preferably is made in the region where maximum forward velocity (and momentum) of the beams is approached in the forward (cutting) direction. Since the cutter blade 94 is in engagement with material to be cut, the adjacent beam is urged forwardly relative thereto, thus to close the momentary gap at the appropriate time of the resonant cycle.

Figure 4:
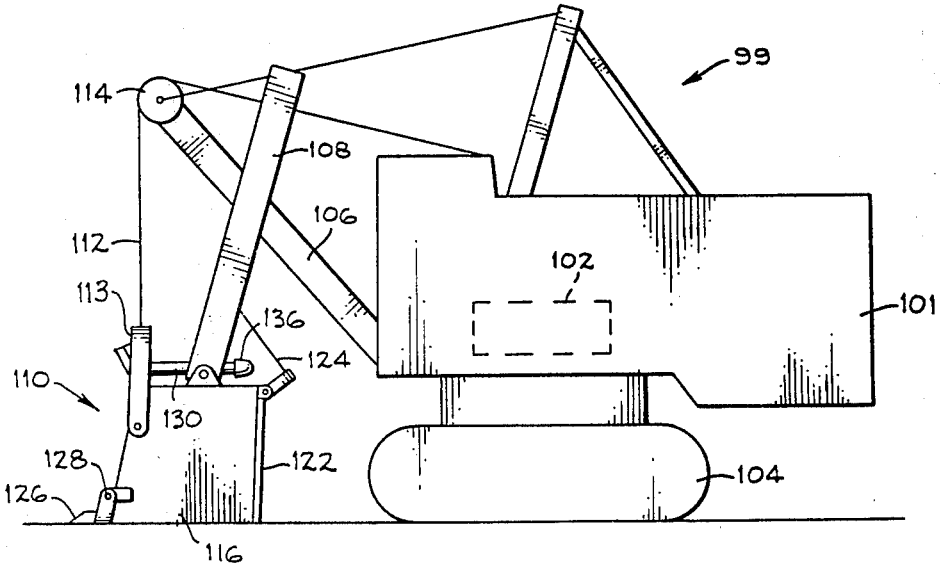
FIG. 4 is a side elevation view of a power shovel incorporating the principles of the invention.

Preferably, cessation of resonance is prevented when the tool encounters an immovable object or unyielding material during the forward movement of mobile carrier 11. Specifically, a protective gap is established between the neutral position of the beam outputs and the tool when the tool is unable to advance along the work path responsive to the impulses transferred to it by beams 54, 54'. (This is to be distinguished from the momentary gap described above, which continuously opens and closes during normal operation through yielding material). In the embodiment disclosed in this specification, the peak sonic force generated by oscillators 56, 56' is substantially greater than the maximum tractive force generated by mobile carrier 11, i.e., the weight of the vehicle and its load. Specifically, the sonic is sufficiently large relative to the tractive force to enable the sonic force to overcome the tractive force and to drive the entire machine, including material cutting assembly 10 and mobile carrier 11, backwards away from the tool when the tool is unable to advance along the work path. In the embodiment of FIGS. 4 through 6, the protective gap is established in a different manner, namely, by a tool stop which prevents the beam output in its neutral position from contacting the tool when it encounters an immovable object. In either way, by thus establishing a protective gap between the beam output in its neutral position and the tool when it encounters an immovable object, cessation of resonance is prevented.

In a typical example, the peak-to-peak excursion of the beam output might be two inches, so that the power stroke of the beam output would be one inch. In such case, if manufacturing variations result in an unshimmed spacing of $1\frac{1}{4}$ of an inch between the neutral position of the output of beam 54 and cutter blade 94, and an unshimmed spacing of $1\frac{1}{4}$ of an inch between the neutral position of the output of beam 54' and cutter blade 94, shims 76' would displace the output of beam 54 by $1\frac{1}{4}$ of an inch, and shims 76' would displace the output of beam 54' by $\frac{1}{2}$ of an inch. Thus, shims 76 and 76' establish precisely the same gap between the neutral position of the outputs of beams 54, 54' and cutter blade 94. Unlike the embodiment of FIGS. 4 through 6 described below, it is principally the relative adjustment in position of beams 54, 54' that it is important for shims 76, 76' to adjust, so it is only necessary to shim one of the resonant beams insofar as synchronization is concerned.

In FIG. 4, a mobile power shovel 99 generally includes a conventional main housing 101 and an engine 102, which powers endless tracks 104 in a conventional fashion with appropriate steering so that the entire unit can be moved to a desired location. A pivoted boom 106 extends forwardly from the main housing 101 and carries a dependent beam or "dip stick" 108. Beam 108 pivotally supports, at its extremity, a shovel bucket 110 and is arranged for pivotal and extensible support on the boom 106 under the control of the machine operator. Cables 112 extend over pulleys 114 from main housing 101 to a yoke 113 that is pivotally attached to the top of bucket 110. Under operator control, cables 112 move the bucket 110 from its digging position, as shown, to a dumping position. Such structure is conventional and will thus not be described in more detail.

As shown in FIG. 5, the shovel bucket 110 has a generally conventional configuration including laterally spaced side walls 116, a top wall 118, a bottom wall 120, and a pivoted rear wall 122. After a load has been dug and the bucket moved to its dumping position, rear wall 122 can be opened by the machine operator through suitable cable connections 124 to allow a load of earth or other materials to be dropped into a dump truck or other desired location.

A conventional shovel bucket has integral with the front of the bottom wall a transverse blade with forwardly projecting cutting teeth. In accordance with the present invention, a separate transverse cutting blade 126, including forwardly projecting teeth is pivotally mounted from shafts 128, 128', which extend outwardly from each side of the bucket, so that cutting blade 126 can move forwardly and rearwardly relative to the bucket itself. Its motion in a rearward direction towards the bucket is limited, in accordance with one aspect of the present invention, by tool stop means which, in the present embodiment, constitutes the front edge of the bottom wall 120.

When in engagement with the earth to be dug, the cutting blade 126 is pivotally reciprocated forward by contact with the lower extremities of two identical parallel angle beams 130, 130' of the type described in detail in my U.S. patent application Ser. No. 973,187, filed Dec. 26, 1978, the disclosure of which is incorporated fully herein by reference. The angle beams 130, 130' are pivotally supported at their node positions by shafts 132, 132' which are mounted on side brackets 134, 134' attached to top wall 118 of the bucket 110. The angle beams 130, 130' have downwardly-extending legs projecting interiorly of the side walls 116 of the bucket 110 to a position adjacent the rear edge of the cutting blade 126 in its cutting position, and horizontally extending legs projecting above the top wall 118 of the bucket 110 to orbiting mass oscillators 136, 136' at their extremities. A hydraulic motor 138 drives oscillators 136, 136' through universal joints 140, 140'; reference is made to application Ser. No. 973,163, for the details of the connection between motor 138 and oscillators 136, 136'.

The reciprocating motion of the downwardly extending legs of the angle beams 130, 130' is forwardly and rearwardly of a central neutral position, which is defined by stop means including stop members 142, 142'. Stop members 142, 142' are mounted on a yoke 143 that extends forwardly and upwardly from top wall 118 between side walls 116 integral with bucket 110. Ears 146, 146' at the node positions of angle beams 130, 130' pivot up against stop members 142, 142'. The neutral position of angle beams 130, 130' is spaced rearwardly from the rear edge of the blade 126 when positioned against the shovel bucket bottom 120, as best shown in FIG. 6. Shims 144, 144' are mounted on stop members 142, 142' to control the gap between the neutral position of angle beams 130, 130' and the rear edge of the blade 126, i.e., the top stop means. This control is for two purposes, namely, to set the protective gap as described in my application Ser. No. 973,187, and to make the gap of both angle beams identical, thereby synchronizing the impacts of the angle beams on the cutter blade.

In a typical example, the peak-to-peak excursion of the beam output might be two inches, and the minimum protective gap might be $\frac{1}{4}$ of an inch, so that the desired power stroke of the beam output would be $\frac{3}{4}$ of an inch. If the manufacturing variations result in an unshimmed spacing of $\frac{3}{8}$ of an inch between the neutral position of the output of angle beam 130 and cutting blade 126, when abutting bottom wall 120 as depicted in FIG. 6, and an unshimmed spacing of $\frac{3}{4}$ of an inch between the neutral position of the output of angle beam 130' and cutting blade 126, when abutting bottom wall 120 as depicted in FIG. 6, shims 144 would displace the output of angle beam 130 by $\frac{1}{8}$ of an inch, and shims 144' would displace the output of angle beam 130' by $\frac{1}{2}$ of an inch. Thus, shims 144 and 144' establish precisely the same desired minimum protective gap for both angle beams 130, 130' namely, $\frac{1}{4}$ of an inch.

When only one side of ears 146, 146' is supported or restrained, as shown in FIG. 5, by stop members 142, 142' and the outputs of angle beams 130, 130' are not loaded, i.e., are not driving a tool that is engaging material to be cut, it has been discovered that the amplitude of resonant vibration at the outputs of angle beams 130, 130' drops off substantially. When the other side of ears 146, 146' is supported or restrained, i.e., ears 146, 146' are clamped with respect to stop members 142, 142', the full amplitude of resonant vibration of the outputs of angle beams 130, 130' is maintained. When the outputs of angle beam 130, 130' are loaded, it is believed that the reaction of the material being cut, transferred through the tool to the outputs of angle beams, 130, 130', will provide the necessary clamping action on ears 146, 146', without necessity for support or restraint on the other side of ears 146, 146'. If that proves to be the case, the embodiment of FIG. 5, where only one side of ears 146, 146' is restrained will provide an advantageous, automatic on-off control of the resonant vibrations, that is, vibration will be at a low amplitude when the outputs of the angle beams 130, 130' are not loaded and will automatically rise to full amplitude when the outputs of angle beams 130, 130' become loaded.

In the event that on-off control is not desired or the reaction of the material being cut does not effectively clamp ears 146, 146', this can be accomplished in the manner shown in FIG. 7 for ear 146. Specifically, an L-shaped bracket 148 is mounted on yoke 143 so one leg thereof is adjacent to the other side of ear 146 from stop 142. After shims 144, 144' are mounted on stop members 142, 142' to establish the protective gap and synchronize the impact of both angle beams as described above, plates or wedges 150 are inserted between the other side of ear 146 and bracket 148 to fill the space therebetween, and thus clamp ear 146 tightly between stop member 142 and bracket 148. This in effect restrains the nodal plane of the angle beam from vibrating. A similar L-shaped bracket is used to clamp ear 146' between stop member 142' and such L-shaped bracket.

Although the invention is illustrated in a pavement planer and a shovel bucket, it could be incorporated into any number of other material working machines such as a coal planer, a bulldozer, and a front end loader. In each case, an appropriate tool is employed. Generally, the invention is applicable to any type of material working function wherein a single tool is driven by two or more force transmitting beams; although the described upper node support and lower node support are particularly advantageous for this purpose, they are also useful in material working machines where the tool is driven by a single force transmitting beam such as the ripper disclosed in my application Ser. No. 937,187, filed on Dec. 26, 1978 timber shearer, or a press.

The described embodiments of the invention are only considered to be preferred and illustrative of the inventive concept; the scope of the invention is not to be restricted to such embodiments. Various and numerous other arrangements may be devised by one skilled in the art without departing from the spirit and scope of this invention. For example, in some embodiments the tool could be fixed to the output of the force transmitting beam rather than being mounted for reciprocation on the tool carrier. Further, the invention is also applicable to machines in which the tool carrier does not advance during operation such as, for example, a stationary press. The resilient pivotal node support shown in FIGS. 1 and 3 could also be employed to support at their single node the angle beams in the embodiment of FIGS. 4 through 6.

What is claimed is:

1. Tool driving apparatus which comprises:

a tool mounted for reciprocal motion;

at least two resonant members mounted adjacent said tool at laterally-spaced positions;

means for energizing resonant vibration of said resonant members to provide periodic force impulses to said tool in the same direction at the laterally-spaced positions;

means for controlling the time application of the force impulses to said tool by said resonant members to effect the synchronous application of force to said tool at the laterally-spaced positions;

stop means for contacting each of said resonant members to define the neutral positions thereof; and means for independently adjusting the positions of said stop means adjacent each of said resonant members.

2. Tool driving apparatus according to claim 1, which comprises means or restricting motion of said tool towards said resonant members to maintain a controlled gap therebetween when said resonant members are in their neutral positions.

3. The apparatus of claim 1 wherein the resonant members each comprise a straight beam having a pair of nodes and anti-nodes at the center and at each end, one end of each beam being an output end providing force impulses to the tool.

4. The apparatus of claim 3 wherein the stop means abuts against the respective beams at the node nearest the output end and limits transverse movement of the beams at said node.

5. The apparatus of claim 1 wherein the resonant members each comprise an angle beam having a pair of legs meeting at a juncture, one end of one leg of each beam being an output end providing force impulses to the tool.

6. The apparatus of claim 5 wherein the stop means limits rotation of the beams at the junctures.

7. The apparatus of claim 1 wherein the adjusting means comprises shims.

8. In apparatus for performing work on a medium, which apparatus has a tool carrier, an elongated tool mounted on the tool carrier for reciprocal motion transverse to the length of the tool, a plurality of resonant beams each having an input, an output, and at least one resonant node, the outputs of the beams being spaced apart adjacent to the length of the tool, a sonic generator coupled to the inputs of the resonant beams to excite the resonant beams to resonant vibration and intermittently drive the tool, means for pivotally attaching the one resonant node of each resonant beam to the support frame, and rigid beam stop means attached to the support frame and positioned to contact each resonant beam while the tool is driven intermittently, the resonant beams pivoting about their one node up against their stop means as a reaction of the medium to the resonant vibration of the resonant beams, a method for synchronizing the outputs of the beams while the beams are not excited, the method comprising the steps of:

bringing the tool into engagement with the medium;

moving the tool carrier toward the tool until one of the beams contacts the stop means; and while the one beam contacts the stop means, shimming the stop means until it contacts the other beam.

9. A method for driving an elongated tool comprising the steps of:

mounting the tool for reciprocal motion transverse to its length;

pivotably mounting a plurality of force transmitting beams each having an input, a resonant node and an output at the anti-nodes so the outputs of the beams are spaced apart adjacent to the length of the tool without attachment to the tool;

coupling sonic vibrations in synchronism to the inputs of the force transmitting beams so their outputs vibrate in synchronism about a neutral position; and coupling the outputs of the force transmitting beams to the tool in synchronism by rigidly limiting rotation of each beam about its one node; and independently adjusting the spacing between the neutral position of the output of each force transmitting beam and the tool so that the spacings are the same.

* * * * *